US005669735A

United States Patent [19]

Blandford

[11] Patent Number: 5,669,735

[45] Date of Patent: Sep. 23, 1997

[54] OFFSHORE PRODUCTION PLATFORM AND METHOD OF INSTALLATION THEREOF

[76] Inventor: Joseph W. Blandford, 10919 Wickline, Houston, Tex. 77024

[21] Appl. No.: 359,591

[22] Filed: Dec. 20, 1994

[51] Int. Cl.[6] ..... E02D 29/09

[52] U.S. Cl. ..... 405/227; 405/195.1

[58] Field of Search ..... 405/195.1, 227, 405/228

[56] References Cited

U.S. PATENT DOCUMENTS

| | | | |
|---|---|---|---|
| 3,516,259 | 6/1970 | Tokola | 405/208 |
| 3,546,885 | 12/1970 | Pogonowski | 405/227 |
| 3,624,702 | 11/1971 | Meheen | 405/227 |
| 3,670,507 | 6/1972 | Mott et al. | 405/227 |
| 4,307,977 | 12/1981 | Haney | 405/228 X |
| 4,556,340 | 12/1985 | Morton | 405/195 |
| 4,558,973 | 12/1985 | Blandford | 405/216 |
| 4,679,964 | 7/1987 | Blandford | 405/216 |
| 4,687,380 | 8/1987 | Meek et al. | 405/204 |
| 4,740,107 | 4/1988 | Casbarian et al. | 405/211 |
| 4,867,611 | 9/1989 | Luyties | 405/195.1 X |
| 4,917,541 | 4/1990 | Carruba | 405/227 |
| 4,983,074 | 1/1991 | Carruba | 405/227 |
| 5,102,266 | 4/1992 | Carruba | 405/195.1 X |
| 5,117,914 | 6/1992 | Blandford | 166/344 |

FOREIGN PATENT DOCUMENTS

| | | | |
|---|---|---|---|
| 48510 | 10/1985 | Japan | 405/227 |
| 48610 | 10/1986 | United Kingdom | 405/227 |

OTHER PUBLICATIONS

Marine Construction Survey—Offshore Incorporating The Oilman—Nov. 1988.

Proposal—"Seashark" Deepwater Well Protector 200'–300' Water Depth Site Gulf of Mexico—Apr. 1987.

*Primary Examiner*—Tamara L. Graysay
*Assistant Examiner*—Tara L. Mayo
*Attorney, Agent, or Firm*—Nick A. Nichols, Jr.

[57] ABSTRACT

An offshore production platform includes one or more decks supported above the water surface for accommodating equipment to process oil, gas, and water recovered from subsea hydrocarbon formations. The decks are supported on four surface piercing columns which are mounted on a support platform substructure, secured to the seabed by tubular piles driven below the mudline through skirt pile sleeves located at the respective corners of the substructure and connected to the substructure by grouting or mechanical means. The base of the platform includes an open framework permitting the platform to be placed over a well template, through which one or more wells may be drilled.

17 Claims, 8 Drawing Sheets

FIG. 2
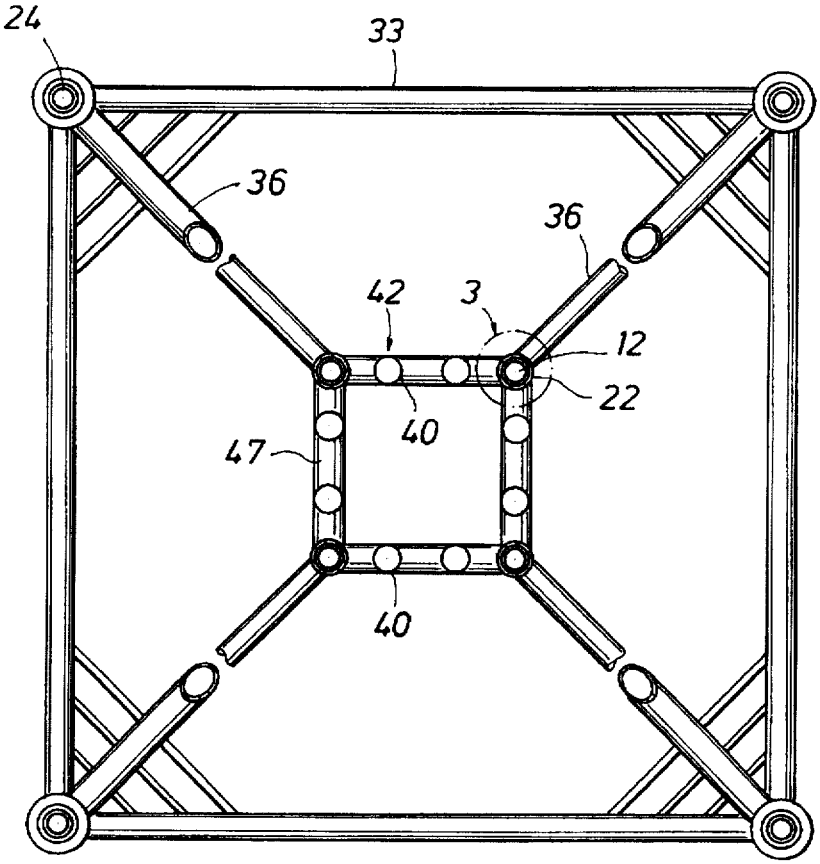
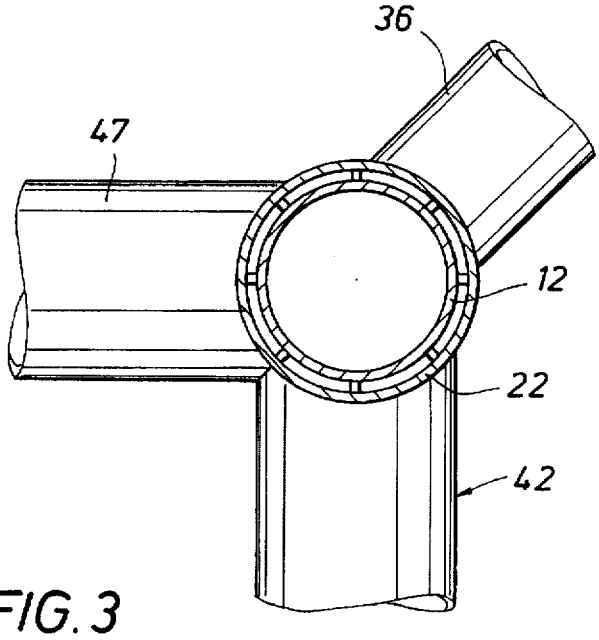
FIG. 3

FIG. 6
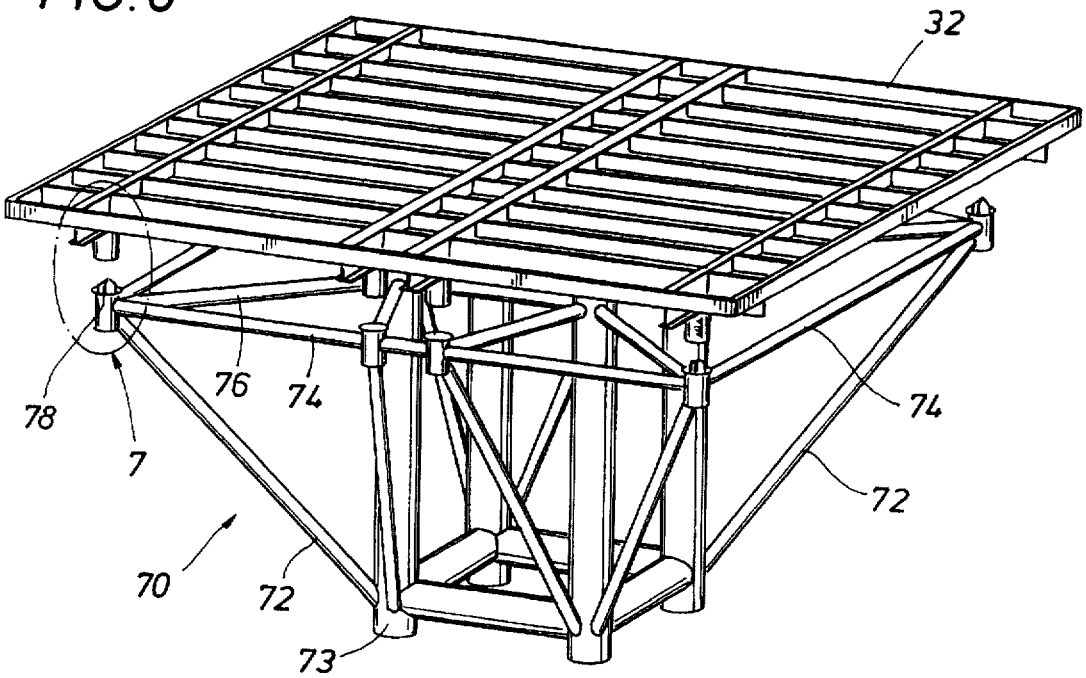
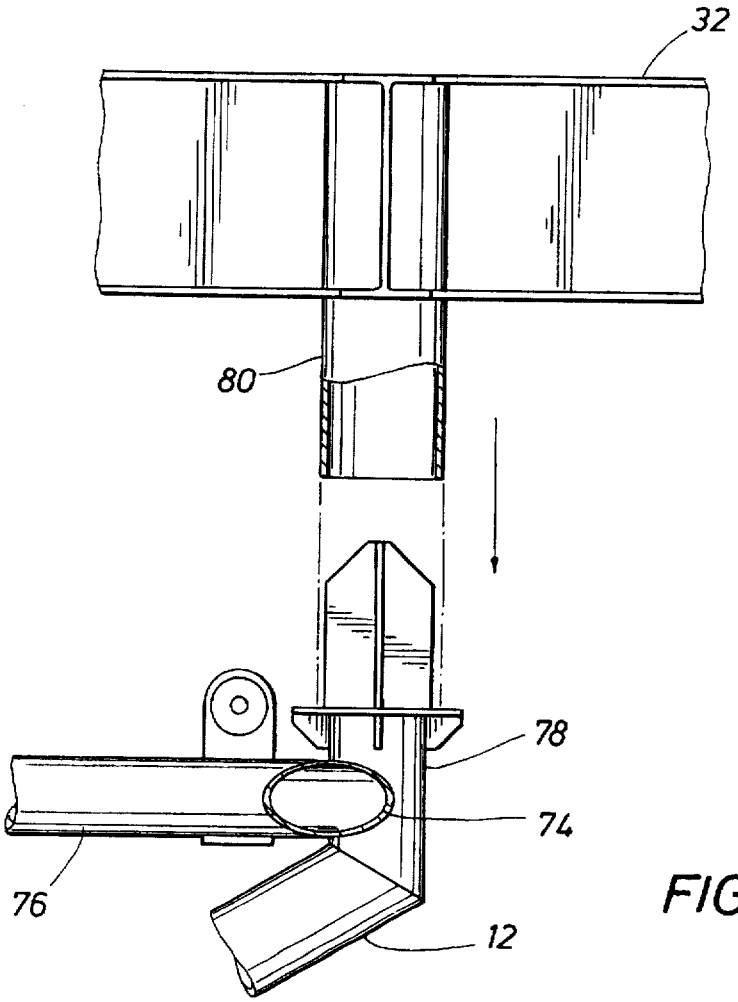
FIG. 7

OFFSHORE PRODUCTION PLATFORM AND METHOD OF INSTALLATION THEREOF

BACKGROUND OF THE DISCLOSURE

The present invention is directed to a method and apparatus for testing and producing hydrocarbon formations found in mid-range (300–600 feet) offshore waters, and in shallower water depths where appropriate, particularly to a method and system for economically producing relatively small hydrocarbon reserves in shallow to mid-range water depths which currently are not economical to produce utilizing conventional technology.

Commercial exploration for oil and gas deposits in U.S. domestic waters, principally the Gulf of Mexico, is moving to deeper waters (over 300 feet) as shallow water reserves are being depleted. Companies must discover large oil and gas fields to justify the large capital expenditure needed to establish commercial production in these water depths. The value of these reserves is further discounted by the long time required to begin production using current high cost and long lead-time designs. As a result, many smaller or "lower tier" offshore fields are deemed to be uneconomical to produce. The economics of these small fields in the mid-range water depths can be significantly enhanced by improving and lowering the capital expenditure of methods and apparatus to produce hydrocarbons from them. It will also have the additional benefit of adding proven reserves to the nation's shrinking oil and gas reserves asset base.

In shallow water depths (up to about 300 feet), in regions where other oil and gas production operations have been established, successful exploration wells drilled by jack-up drilling units are routinely completed and produced. Such completion is often economically attractive because light weight bottom founded structures can be installed to support the surface-piercing conductor pipe left by the jack-up drilling unit and the production equipment and decks installed above the water line, used to process the oil and gas produced there. Moreover, in a region where production operations have already been established, available pipeline capacities are relatively close, making pipeline hook-ups economically viable. Furthermore, since platform supported wells in shallow water can be drilled or worked over (maintained) by jack-up rigs, shallow water platforms are not usually designed to support heavy drilling equipment on their decks, unless jack-up rigs go into high demand. This enables the platform designer to make the shallow water platform light weight and low cost, so that smaller reservoirs may be made commercially feasible to produce.

Significant hydrocarbon discoveries in water depths over about 300 feet are typically exploited by means of centralized drilling and production operations that achieve economies of scale. For example, since typical jack-up drilling rigs cannot operate in waters deeper than 300 feet, a platform's deck must be of a size and strength to support and accommodate a standard deck-mounted drilling rig. This can add 300 to 500 tons to the weight of the deck, and an equal amount to the weight of the substructure. Such large structures and the high costs associated with them cannot be justified unless large oil or gas fields with the potential for many wells are discovered.

Depending on geological complexity, the presence of commercially exploitable reserves in water depths of 300 feet or more is verified by a program of drilling and testing one or more exploration and delineation wells. The total period of time from drilling a successful exploration well to first production from a central drilling and producing platform in the mid-range water depths typically ranges from two to five years.

A complete definition of the reservoir and its producing characteristics is not available until the reservoir is produced for an extended period of time, usually one or more years. However, it is necessary to design and construct the production platform and facility before the producing characteristics of the reservoir are precisely defined. This often results in facilities with either excess or insufficient allowance for the number of wells required to efficiently produce the reservoir and excess or insufficient plant capacity at an offshore location where modifications are very costly.

Production and testing systems in deep waters in the past have included converting Mobile Offshore Drilling Units ("MODU's") into production or testing platforms by installing oil and gas processing equipment on their decks. A MODU is not economically possible for early production of less prolific wells due to its high daily cost, and when the market tightens, such conversions are not considered economical. Similarly, converted tanker early production systems, heretofore used because they were plentiful and cheap, can also be uneconomic for less prolific wells. In addition, environmental concerns (particularly in the U.S. Gulf of Mexico) have reduced the desirability of using tankers for production facilities instead of platforms. Tankers are difficult to keep on station during a storm, and there is always a pollution risk, in addition to the extreme danger of having fired equipment on the deck of a ship that is full of oil or gas liquids. This prohibition is expected to spread to other parts of the world as international offshore oil producing regions become more environmentally sensitive.

As noted in U.S. Pat. No. 4,556,340 (Morton), floating hydrocarbon production facilities have been utilized for development of marginally economic discoveries, early production and extended reservoir testing. Floating hydrocarbon production facilities also offer the advantage of being easily moved to another field for additional production work and may be used to obtain early production prior to construction of permanent, bottom founded structures. Floating production facilities have heretofore been used to produce marginal subsea reservoirs which could not otherwise be economically produced. In the aforementioned U.S. Pat. No. 4,556,340, production from a subsea wellhead to a floating production facility is realized by the use of a substantially neutrally buoyant flexible production riser which includes biasing means for shaping the riser in an oriented broad arc. The broad arc configuration permits the use of wire line well service tools through the riser system.

An FPS (Floating Production System) consists of a semi-submersible floater, riser, catenary mooring system, subsea system, export pipelines, and production facilities. Significant system elements of an FPS do not materially reduce in size and cost with a reduction in number of wells or throughput. Consequently, there are limitations on how well an FPS can adapt to the economic constraints imposed by marginal fields or reservoir testing situations. The cost of the semi-submersible vessel (conversion or newbuild) and deep-water mooring system alone would be prohibitive for many of these applications.

A conventional TLP (Tension Leg Platform) consists of a four column semi-submersible floating substructure, multiple vertical tendons attached at each corner, tendon anchors to the seabed, and well risers. A single leg TLP has four columns and a single tendon/well. The conventional TLP deck is supported by four columns that pierce the water plane. These types of TLP's typically bring well(s) to the surface for completion and are meant to support from 20 to 60 wells at a single surface location.

The TLP size can be reduced, as taught by U.S. Pat. No. 5,117,914 (Blandford). The purpose of the size reduction was to reduce the costs associated with the TLP design, construction, and installation, thereby allowing smaller offshore deepwater fields with fewer wells to be economically developed. However, even small TLP platforms are expensive for the mid-range water depths, when compared to bottom-founded platforms.

U.S. Pat. No. 4,558,973 (Blandford) discloses a means to support a well below the water surface with a pyramid-shaped jacket structure consisting of steel tubular braces connected together by welding and/or bolting, and attached to the seabed by four steel tubular piles driven by a pile hammer to their design penetrations below the ocean floor. U.S. Pat. No. 4,679,964 (Blandford) expands the structure to support more than one well above the water surface by one or two surface-piercing deck columns and connected to the seabed by four driven piles.

U.S. Pat. No. 4,983,074 (Carruba) discloses a means to support one or more wells by a below-water support structure utilizing a hollow pile disposed within one leg of a three-legged structure for supporting an offshore platform, wherein the hollow pile is fixedly secured to the tubular leg within which it is disposed.

These bottom-founded jacketed structures are not intended to support drilling or completion equipment. They are typically intended to be placed in water depths in which jack-up drilling rigs could standardly operate, less than 300 feet.

Conventional platforms installed in the mid-range water depths consist of the standard four-pile, six-pile, and eight-pile variety. A tripod (three-pile) configuration is also available. These platforms consist of jacketed structures that are more or less rectangular or box-shaped with piles and tubular bracing extending from above the water surface to the seabed. The deck legs are installed into the tops of the piles, which are cut off at about 15 feet above the water surface after being driven to their design penetrations through the surface-piercing jacket legs. Large diameter deck legs extend up to and support the deck. Wells are drilled by a deck-mounted drilling rig. The wells are located in the approximate center of the platform and extend to the seabed separately from the deck legs. The deck legs, the wells, the jacket structure, and associated appurtenances all are subject to hurricane storm wave, wind, and current loads that must be transferred via the jacket substructure to the pile foundation.

Platform designers have attempted to reduce the size and cost of these conventional platform structures by terminating some of the piles below the water surface and connecting them to the base of the structure. These platforms are characterized by widening the distance among the legs and increasing their diameter, called "stretching." This results in a slight decrease in weight and cost of the jacket but an increase in weight and cost of the piles. Any savings have not proved to be enough to permit economical development of marginal offshore oil and gas fields.

The '914 and '973 structures taught by Blandford and the '074 structure taught by Carruba were conceived to take advantage of the basic parameters and criteria of offshore design. First, maximum wave load pressures occur at the wave crest, which is high on a platform, and decay to zero some small distance below the wave crest. Second, maximum storm currents occur at the water surface and usually decay to zero or close to zero some distance below the water surface. Third, storm wind loads occurring above the water surface are smallest at the surface and increase with distance above the water surface. These storm load configurations act on offshore structures in a manner similar to loads on other structures, where the bending stresses increase with an increase in the moment arm, i.e., as the distance from the load increases. The maximum overturning moment on an offshore platform jacket occurs, then, at or just below the seabed. Blandford taught that a pyramid-shaped jacket substructure permitted the greatest transparency to storm loads in the zones of maximum loading (at the top of the pyramid) and provided the greatest amount of structural strength at the seabed (at the base of the pyramid), where overturning movements and bending stresses on the jacket are the greatest.

The system of the present disclosure efficiently and economically supports a production operation in mid-range water depths, where the structures disclosed by Blandford in U.S. Pat. Nos. 4,558,973 and 4,983,074 would not be appropriate, because those structures would not adequately support a deck-mounted drilling unit in water too deep to be accessed by jack-up drilling rigs. In order to operate in water depths of 300 to 600 feet, it is necessary to support the deck with four vertical columns, which will support a deck sufficient in size to accommodate a deck-mounted drilling, completion or workover unit, and brace the columns into a jacketed substructure for the most efficient transfer of environmental loads to the pile foundation, utilizing load transparency whenever possible.

SUMMARY OF THE INVENTION

The present invention provides a system for producing and processing well fluids produced from subsea hydrocarbon formations. The production platform includes one or more decks supported above the water surface for accommodating equipment to process oil, gas and water recovered from the subsea hydrocarbon formations. The decks are supported on four surface-piercing columns which are mounted on a support platform substructure, secured to the seabed by steel tubular piles driven below the mudline through the skirt pile sleeves located at the corners and connected to the substructure by grouting or mechanical means. The base of the platform includes an open framework permitting the platform to be placed over a well template, through which one or more wells may be drilled before the platform is installed at the offshore site. The deck may contain a framing structure to accommodate a deck-mounted drilling rig. The primary components of the present invention are modular for ease of installation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a sectional plan view taken along line 2—2 of FIG. 1;

FIG. 3 is a partial exploded view depicting a corner connection of the well conductor spacer framing of the invention;

FIG. 6 is a partial perspective view of the deck framing of the invention;

FIG. 7 is a partial exploded view depicting a corner connection of the deck framework to the spider deck support structure of the invention;

DETAILED DESCRIPTION OF THE INVENTION

Figure 1:
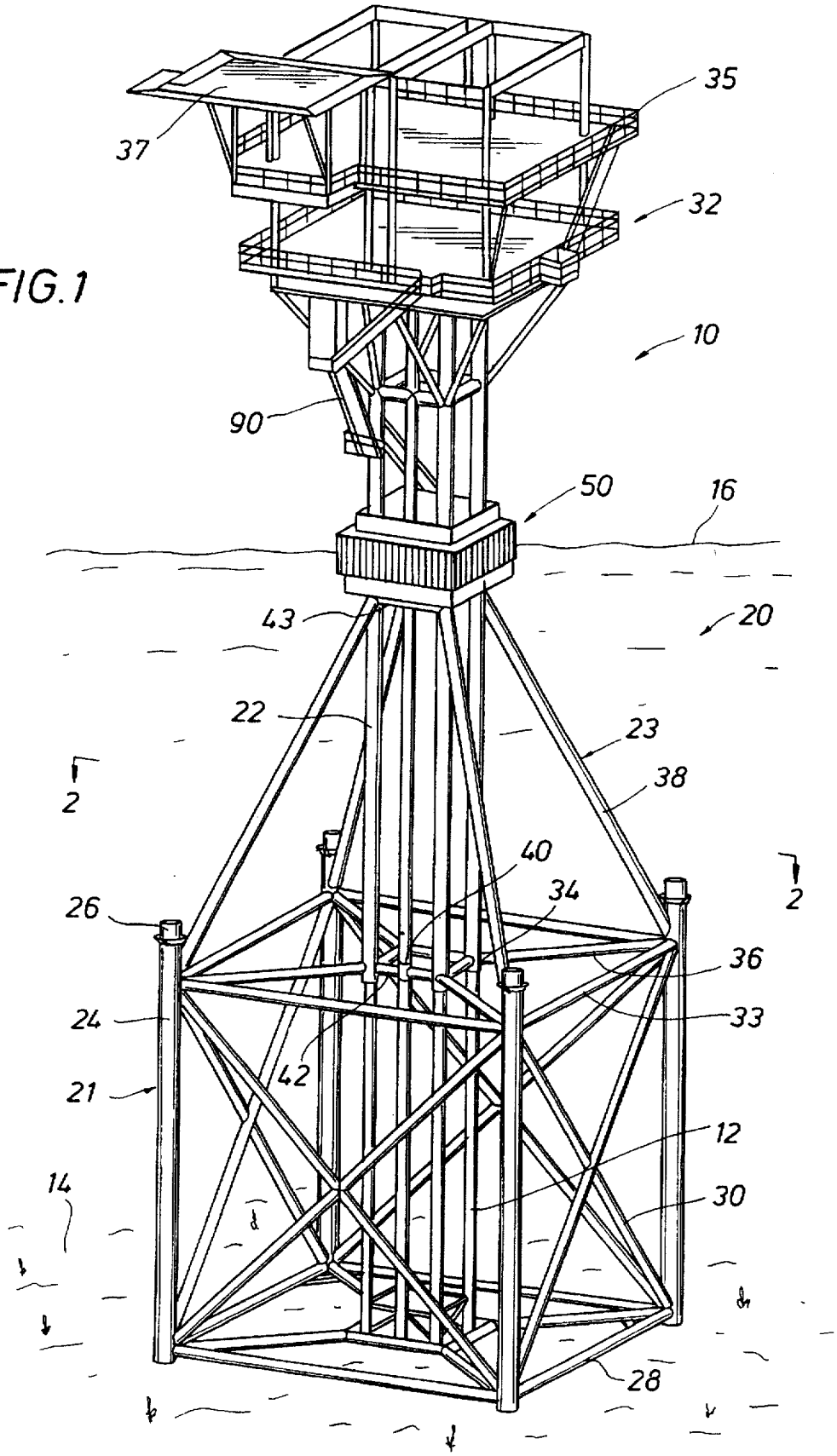
FIG. 1 is an elevational environmental view showing the production platform of the present invention.

Attention is first directed to FIG. 1 of the drawings. In FIG. 1, the production platform of the invention, generally identified by the reference numeral 10, is shown installed at an offshore well site. Assume that one or more wells have been completed at the well site and are evidenced primarily by conductor pipes 12 extending from the seabed 14. Assume further that the conductor pipe is typically quite long, perhaps a few hundred feet in length, so that it stands 20 feet or more above the water line 16. The conductor pipe 12 is typically fabricated of pipe up to about 36 inches in diameter and may enclose various and sundry cutoff valves, production equipment and the like. Typically, the conductor pipe protrudes vertically above the water line 16. The production platform 10 of the invention is installed at the well site forming a protective structure about the conductor pipe or pipes 12, and providing support for them up to the deck level.

The production platform 10 comprises several modular components which are fabricated onshore and towed to the well site for installation. Beginning at the lower portion of the production platform 10, the underwater platform substructure 20 comprises a lower base or box support structure 21 and an upper pyramid support structure 23 comprised of upstanding deck support columns 22 and vertical diagonal members 38 that are connected to hollow piling sleeves 24. The base 21 of the platform substructure 20 defines a substantially rectangular support structure formed by a plurality of bracing members connected to the four corners of the platform substructure 20. The corners of the platform substructure 20 are formed by hollow piling sleeves 24. Piles 26, driven through the piling sleeves 24, anchor the platform substructure 20 to the seabed 14. Horizontal and diagonal brace members provide sufficient bracing to form a rigid support structure. The lower base 21 of platform substructure 20 forms a hollow cube-like support structure, each face of the cube being defined by lower and upper horizontal brace members 28 and 33 and diagonal brace members 30 extending between corner piling sleeves 24.

The upper portion of the platform substructure 20 is a pyramidal support structure 23 that is defined by the upstanding deck support columns 22, the vertical diagonal tubular members 38 on the sides, and the horizontal diagonal members 36.

The configuration of the platform substructure 20 is specially adapted to transmit load forces to the corner piling sleeves 24. The loads occur from wind, waves, current, and occasional impact acting on the structure in day-to-day operating conditions and in extreme event storm conditions, such as hurricanes. The four deck support columns 22 shown in FIG. 1 are spaced so that a well conductor pipe 12 may extend through each of them to the deck surface. This enables the conductor pipes 12 to extend from the mudline to the deck without themselves picking up loads or transmitting forces from other parts of the structure. The close spacing of the deck columns 22 and the well conductor pipes 12 enclosed within this area permit shielding of loads caused by environmental conditions such as wind, waves, and current. Loads picked up by the deck column/well conductor system of the present disclosure are therefore less than would be sustained by a conventional platform, where shielding is not appropriate. The diagonal brace members 38 shown in the vertical plane and the diagonal brace members 36 shown in the horizontal plane of FIG. 1 transmit the loads from the deck column 22 to the pile sleeves 24. The loads and the stresses resulting therefrom are more or less uniformly distributed throughout the base structure load paths, and into the piles, where they are finally transmitted into the seabed foundation.

The platform substructure 20 is specially adapted to transmit reduced load forces compared to more conventional platforms by virtue of the load sustaining mechanism of the deck columns 22 and the well conductors 12 supported by well conductor framing 42 due to the close spacing of these components and the natural shielding affects that occur therefrom. Conventional platforms extend the piles, the pile sleeves, and all bracing members from the seabed up to a point above the waterline. The deck legs or the deck support columns are typically spaced outwardly from the wells so that they can be inserted into the tops of their respective piles. This large spacing creates a complex system of structural members in the zone of maximum loading by wind, waves, current, and impact, that must be transmitted down to the lower part of the conventional platform substructure and into the pile foundation. The conventional platform system requires considerably larger diameter members, heavier structure, and higher costs than the present invention. The present invention allows for a high number of structural members and a wide support base at the seabed 14 where the platform overturning moment is greatest, and yet is relatively transparent to wind, wave, current, and impact forces in the zone of maximum loading, due to fewer members with greater transparencies to these loads. This configuration enables the structure to sustain these loads with optimum transfer of forces and stresses to the structural system.

Referring again to FIG. 1, it will be observed that the perimeter dimensions of the platform substructure 20 are greater at the seabed 14 than the perimeter dimension of the deck support columns 22. As discussed previously, the minimal spacing of the deck columns 22 to each other and to the wells permits the load shielding to occur and gives the platform a high degree of relative transparency to external forces.

The support columns 22 extend upward from the center of the platform substructure 20. The lower ends 34 of the support columns 22 are welded to diagonal brace members 36, defining the upper horizontal face of the platform substructure base 21. Angular brace members 38 extend from each corner of the base 21 at an angle of between approximately 25° and 45° and connect at a point on the support columns 22 usually below the waterline 16. Bracing members forming the conductor pipe support frame 42 extend in a horizontal plane between the support columns 22 at the lower ends thereof. Additional column support framing 43 is provided for the support columns 22 below the deck 32 to provide additional structural support and spacing for the support columns 22 and well conductors 12. Thus, the conductor pipe support framing 42 and 43, angular bracing 38 and diagonal bracing 36 form a sub-structure for rigidly supporting the support columns 22 on the base 21 of the platform substructure 20.

Referring now to FIG. 2 and FIG. 3, the conductor pipe support frame 42 is shown in greater detail. It will be observed that the conductor support frame 42 comprises bracing members 47, which extend between the support columns 22, forming the substantially square support frame 42 lying in a horizontal plane relative to the vertical support columns 22 Additional well conductor guides 40 may extend through the bracing members 47. The guides 40 provide a means for supporting additional well conductor pipes 12 extending from the seabed 14 between the columns 22 to the deck 32.

As noted above, the structure of the present disclosure accommodates up to four wells defined by conductor pipes 12 extending from the seabed 14 to the production deck 32, one well through each of the support columns 22. As many as eight more wells, one through each of the well guides 40, may also be accommodated. The conductor pipes 12 may be totally or partially enclosed or jacketed by the support columns 22. As noted above, typically the load forces acting on offshore structures are highest at the water surface and a short distance below the water surface. Consequently, load forces acting on the conductor pipes 12 at the seabed 14 are minimal and, therefore, jacketing the conductor pipe 12 to the seabed is not typically necessary.

Figure 4:
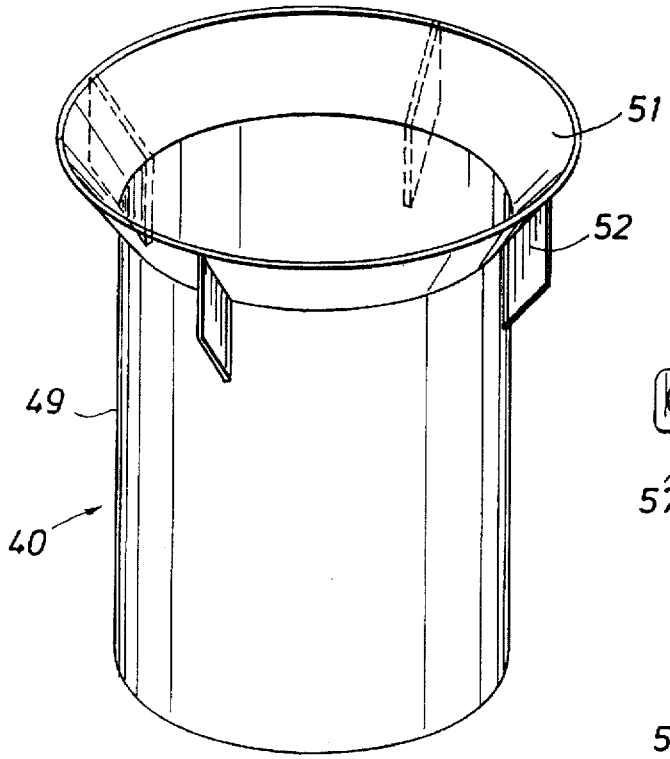
FIG. 4 is a side elevation view of a sleeve guide of the invention.

Referring now to FIG. 4, a well conductor guide 40 is shown in greater detail. A plurality of well guides 40 may be incorporated in the well support framing as shown in FIG. 2. Each guide 40 comprises a cylindrical body 49 open at both ends. A flared flange 51 welded about the upper end of the cylindrical body 49 acts as a stabbing guide for directing the conductor pipe 12 through the guide 40 as the pipe 12 is lowered to the seabed. Support tabs 52 welded to the guide flange 51 and the body 49 of the guide 40 provide structural support for the guide flange 51. The guides 40 extend through the bracing members 47 and are welded thereon providing a passageway for conductor pipes 12 through the well support framing 42 and 43.

Figure 5:
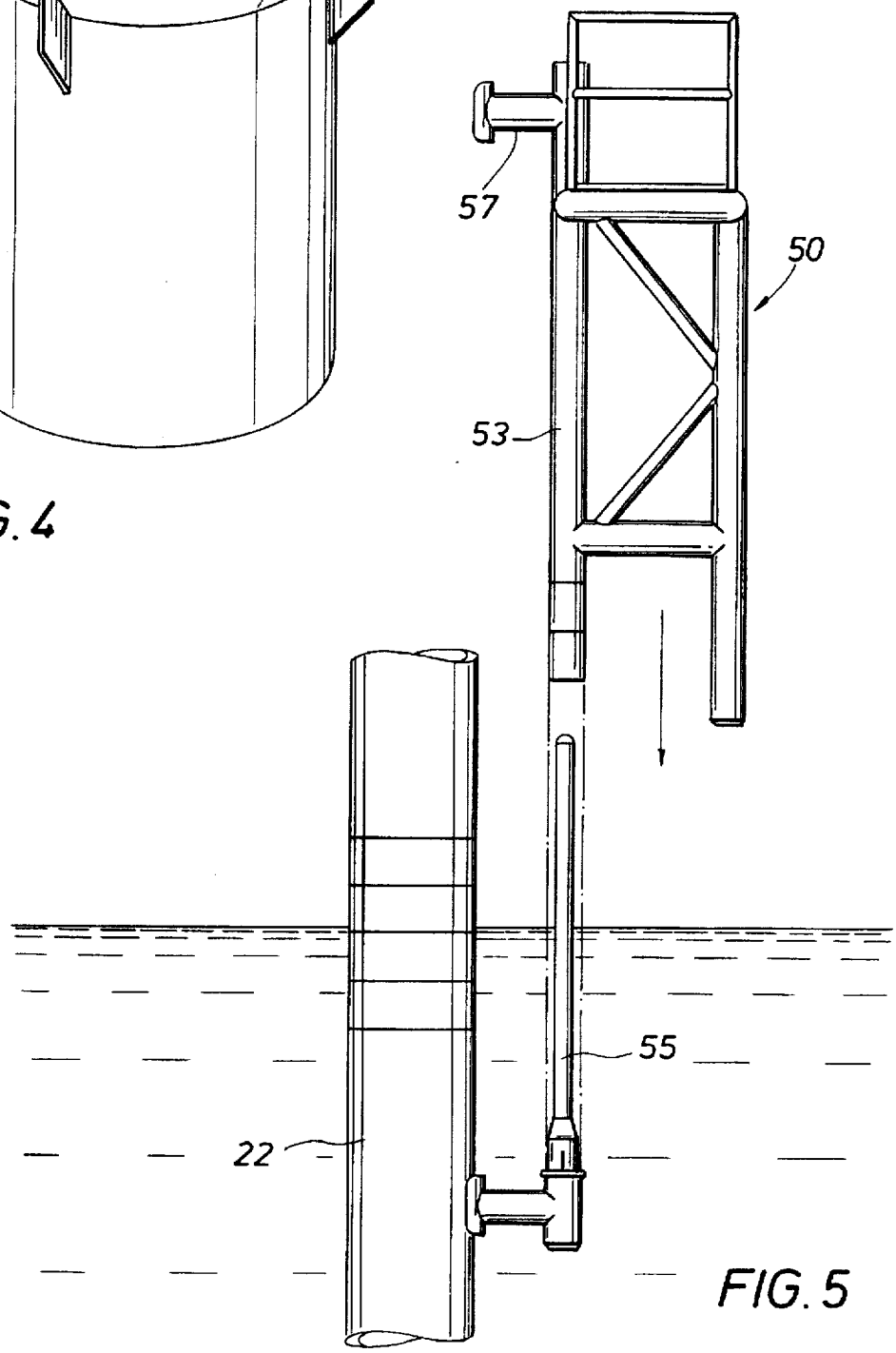
FIG. 5 is a partial side view depicting mounting the boat landing of the invention to a support column.

Referring again to FIG. 1, the support columns 22 extend above the waterline 16 for supporting the deck 32 thereon, approximately 25 to 60 feet above the water surface 16, depending on storm conditions in the region of installation. The modular components forming the boat landing 50 are mounted on the support columns 22 at the water surface 16. The modular construction permits the boat landing 50 to be separately transported to the well site and installed after installation of the platform substructure 20 and support columns 22 are completed. Because water depth is never exactly known at a particular installation site until the platform substructure 20 is anchored to the seabed 14, the boat landing 50 is designed so that it may be adjusted to the exact water depth, by cutting off sections of the boat landing stabbing guides 53 at the lower ends thereof, as required. The boat landing 50 may extend all around the support columns 22 or only partially around them. The boat landing 50 is supported on the support columns 22 on king posts 55, which are mounted on the support columns 22, as best shown in FIG. 5. Once in position, the upper end of the boat landing 50 is secured to the support column 22 by welding a brace member 57 extending therefrom to the support column 22.

As noted herein, the production platform 10 is ideally suited for installation in water depths of 300 to 600 feet. The modular construction of the production platform 10 permits the platform substructure 20 to be fabricated on shore in separate sections or modules, which may then be assembled at the fabrication yard into a single platform substructure or separately transported to the well site in the quantities needed to accommodate the water depth. For example, the height dimension of the base 21 of the platform substructure 20 may be 200 feet and the support columns 22 may extend 100 feet, for a total height dimension of 300 feet. The production platform 10, however, may easily be installed in greater water depths simply by installing an additional box module below the platform substructure 20, as will hereinafter be discussed in greater detail.

The production platform 10 may also be installed and operated in water depths less than 300 feet by reducing the size, changing the number of, or eliminating entirely the base 21 below the pyramid module 23 of the platform substructure 20. This embodiment for use in shallower waters would have application when expensive jack-up rigs are not readily available or are too expensive to justify bringing on location, or when appropriately used as a "high consequence of failure" structure as defined in the industry code API RP 2A, 20th Edition. This code forbids the use of minimal platforms when they are classified as "high consequence of failure" structures, in which black oil is produced or permanent quarters (for manning) exist, or both. The present disclosure has been approved by the U.S. Minerals Management Service for use as a "high consequence of failure" structure. The present disclosure is therefore also intended for use in cases where black oil is produced, in instances where a structure is permanently manned, or both, and in certain load situations where a stiffer offshore platform is appropriate to withstand severe regional loadings. The rig deck 32 may be designed to accommodate a drilling rig or a well completion rig, as required. This deck framing structure would usually be empty of equipment, except when a rig is installed on top of it, to perform drilling and/or workover and/or well completion operations.

The deck which may be supported by the platform structure 10 may vary from a very simple production platform to the multi-level deck structure shown in FIG. 1. As best shown in FIG. 6, the deck 32 is supported atop a spider deck 70. The spider deck 70 comprises a plurality of bracing members 72, 74, and 76 forming a support substructure for the deck 32, and mounted on the support columns 22 above the water line 16. The upper portion of the spider deck is defined by tubular framing members 74 and 76. Stabbing cups 78 are located at each corner of the upper portion of the spider deck 70 to accept the deck 32. The deck 32 is provided with downwardly extending stabbing guides 80 as best shown in FIG. 7. The stabbing guides 80 may be trimmed to enable the deck 32 to be leveled when it is installed on the spider deck 70.

The modular stairs 90 are installed at the offshore site and when installed extend from the modular boat landing 50 to either the spider deck 70 or to the deck 32, depending on which has been installed at the time. The modular stairs 90 allow access and egress between the boat landing 50 and the deck elevation.

The production platform 10 shown in FIG. 1 is installed offshore in components. Installation in components permits the use of readily available offshore equipment, such as derrick barges or in some instances jack-up construction barges or jack-up drilling rigs, to install the offshore platform. Offshore installation equipment typically have limitations as regards lift capacity for installing any single platform component. Those items of equipment having very high lift capacity are rare and therefore very expensive. Modularization of the production platform 10 permits the use of smaller and more available (and less costly) offshore equipment to install the production platform 10 and various components, with the objective that each one of the components will have lower weight than the maximum capacity of the smaller installation equipment that is readily available in the offshore areas around the world.

Figure 8:
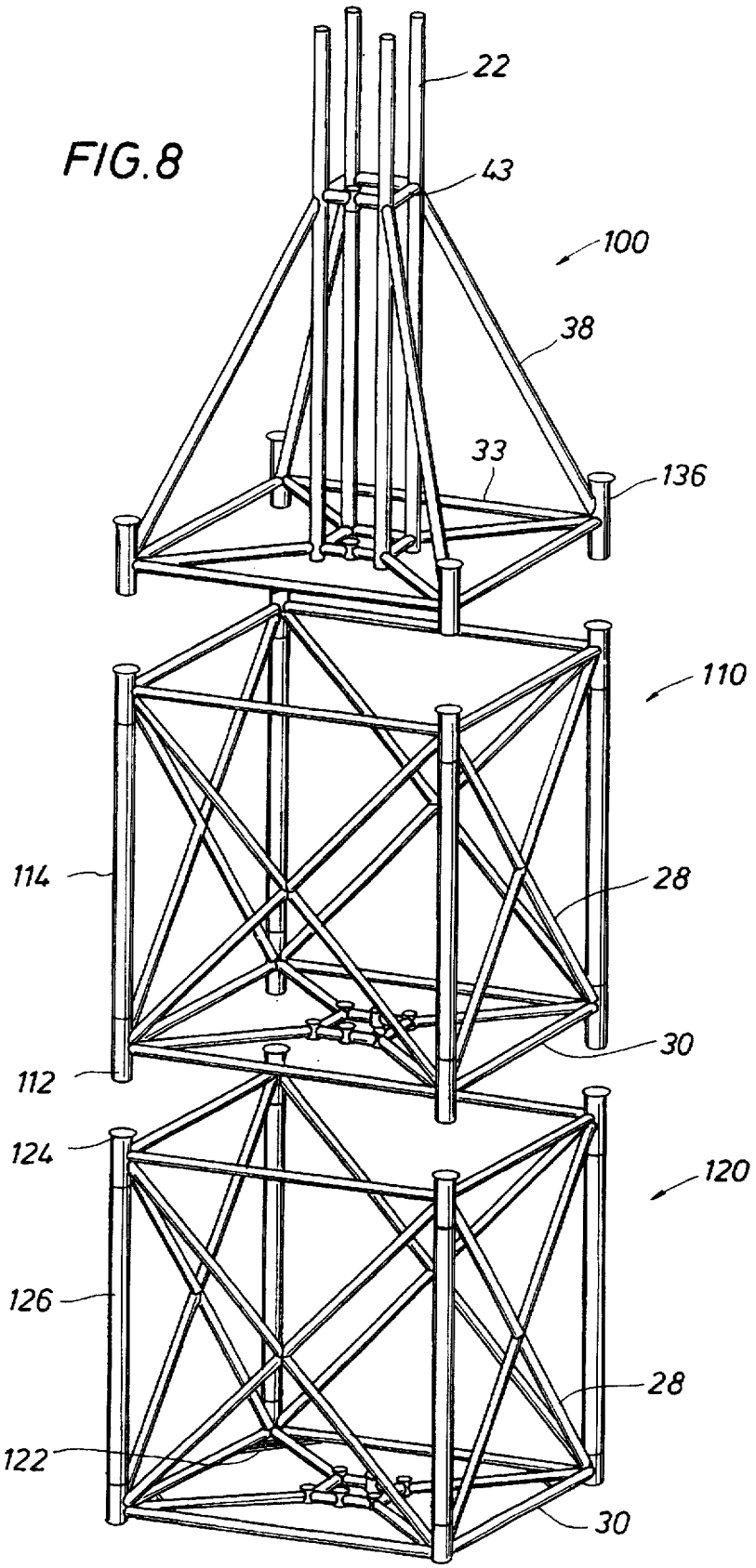
FIG. 8 is an exploded view depicting the modular components of the invention.

The largest single lift in the installation of a platform is usually the platform substructure, which in the case of the present invention would consist of the deck support columns 22, without the spider deck 70 or the boat landing 50 mounted thereon, down to the bottom of the platform substructure 20 and may or may not include the piles 26 that are driven through the piles sleeves 24. The objective is to keep the total lift weight of this component below 500 short tons, so that it can be installed with equipment that is readily available and inexpensive. If the platform substructure 20 is too heavy to be lifted by readily available equipment, then it may be appropriate to prefabricate the platform substructure into separate modules and transport them to the offshore site. In this case, the platform substructure 20 would consist of at least two modules, as shown in FIG. 8, the top being a pyramid module 100, and the bottom module being a box module 110. The box module 110 would be comprised of pile sleeves 24, diagonal bracing 30 in the vertical plane (which may be x-bracing, k-bracing, or diagonal bracing), the mudline horizontal and diagonal bracing located at the base of the box module 110, and brace members in the horizontal plane at the top of the box module 110 connecting the pile sleeves 24.

If more than one box module 110 is required for greater water depths, additional box modules 120 (FIG. 8) may be transported to the site separately and coupled together in the same fashion with the same apparatus. In each instance, each box module 110 and 120 and each pyramid module 100 will be of sufficient structural integrity to permit lifting and installation at the offshore installation site. Connecting the modules together at the site may be accomplished by mechanical means or by grouting of the pile-pile sleeve annulus, with the pile in place to be described in greater detail later herein.

Figure 9:
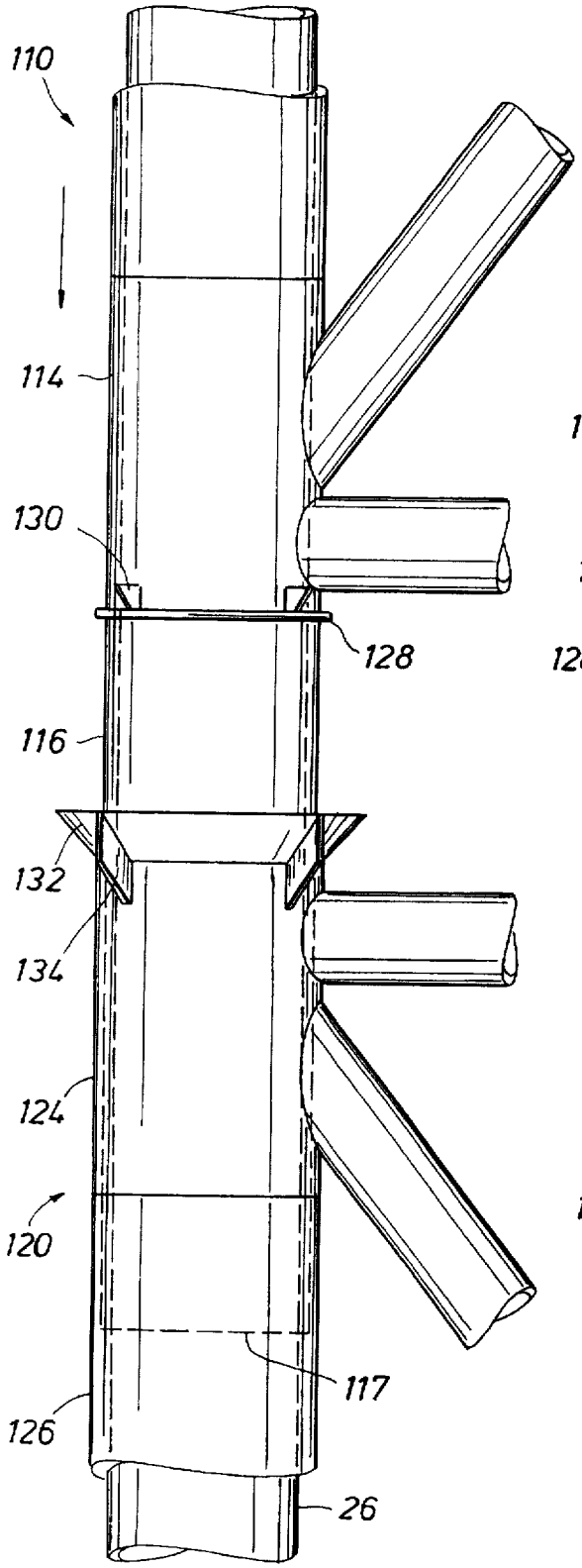
FIG. 9 is a partial side view depicting the pile connection of the modular components of the invention.
Figure 10:
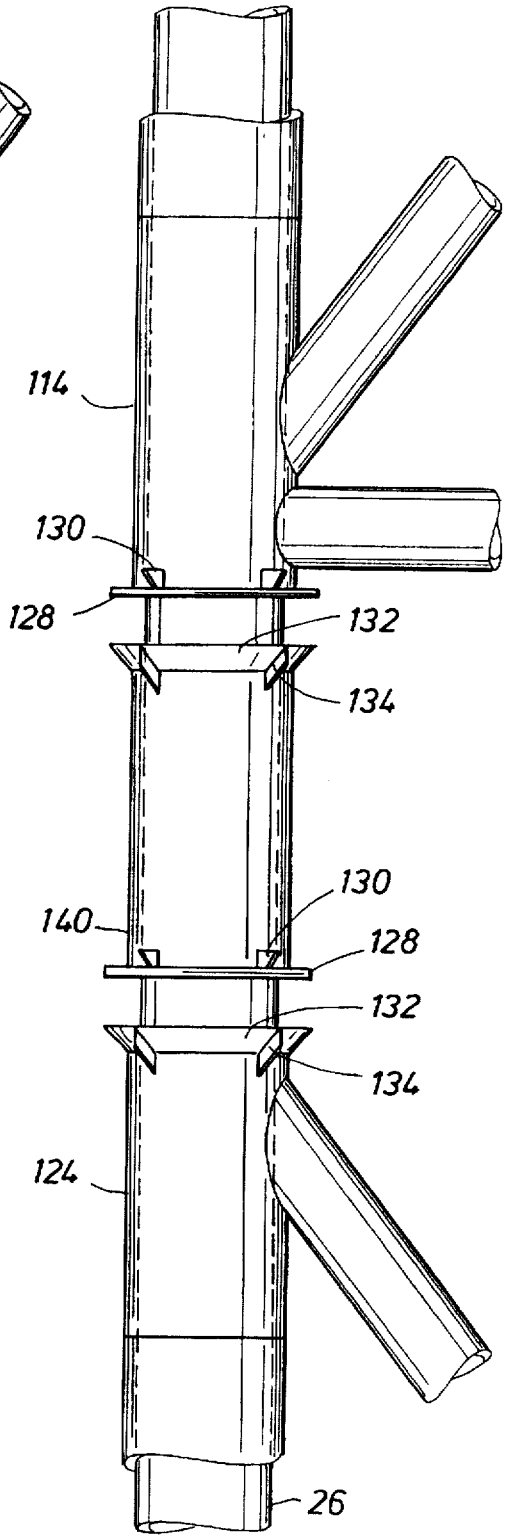
FIG. 10 is a partial side view depicting a spacer component position between the modular components of the invention.
Figure 11:
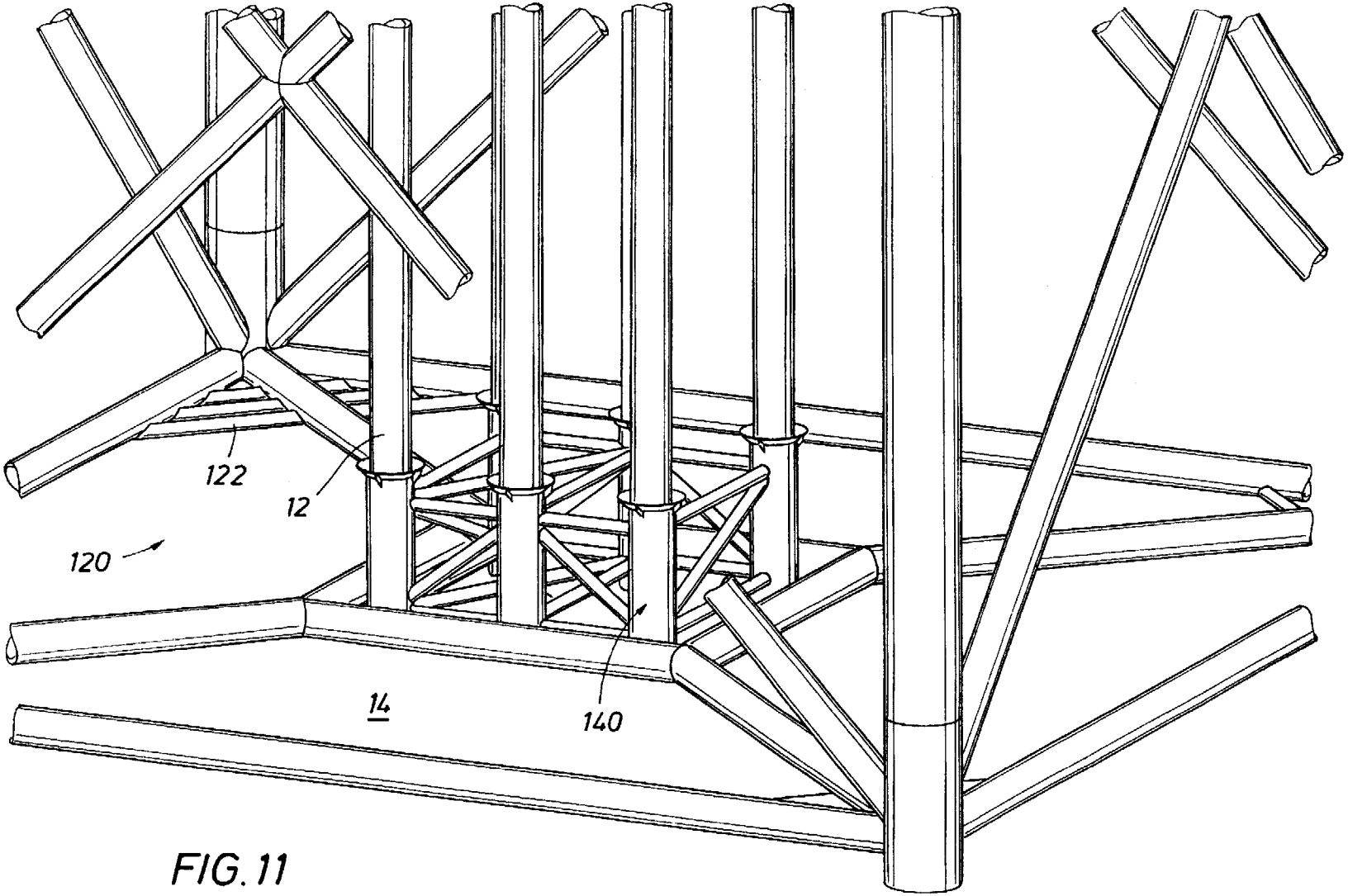
FIG. 11 is an enlarged partial view depicting the placement of the bottom most module of the invention about the well template on the seabed.
Figure 12:
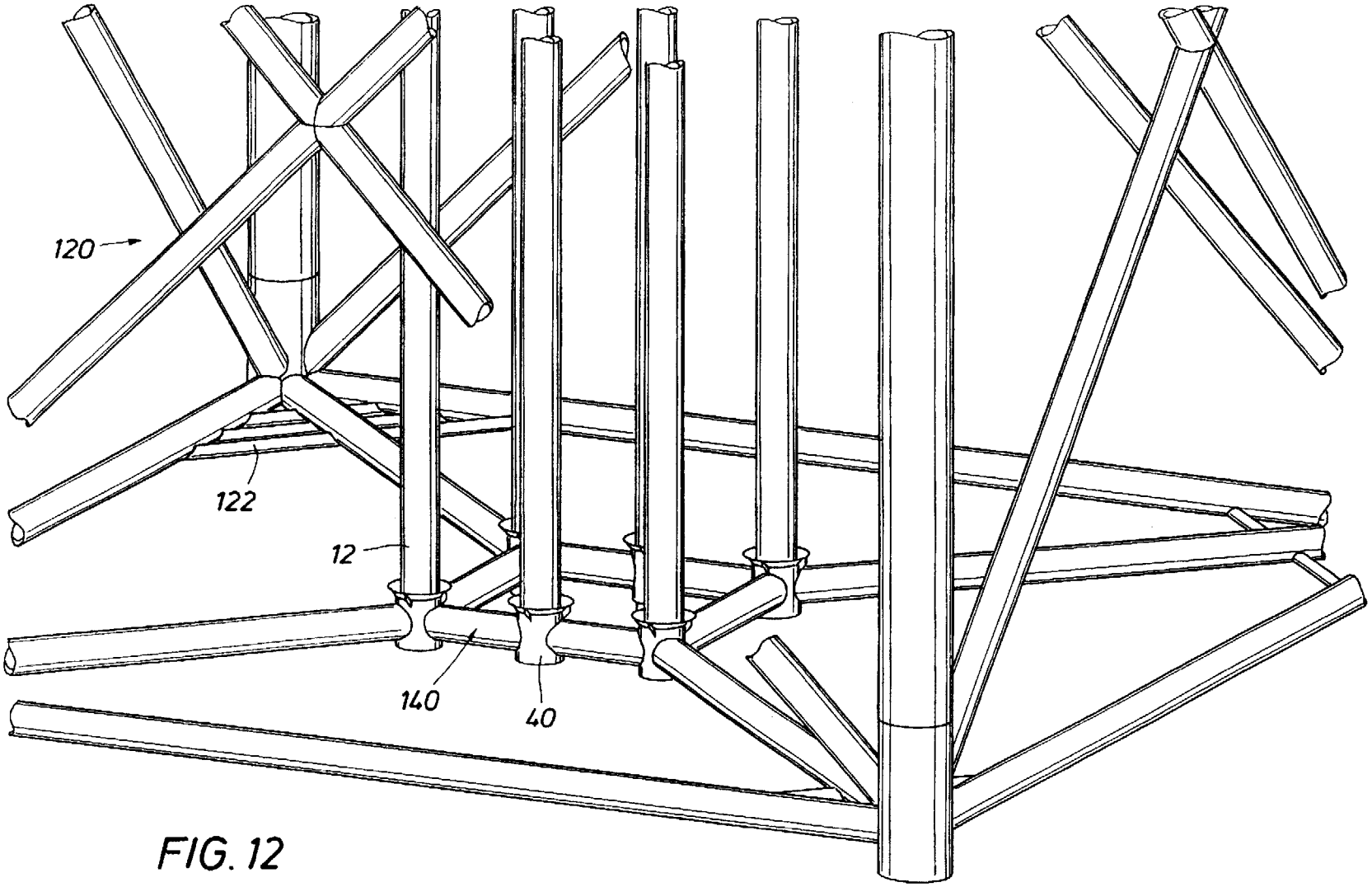
FIG. 12 is an enlarged partial view depicting an alternate well template structure.

Referring now to FIGS. 8–10, the modular installation method of the invention will be described in greater detail. First, all modules are transported to the offshore platform site, where the platform is to be installed. The lower box module 120, which can be determined by an inspection of the bottom of its structure, having steel plate mudmats 122, is lifted and lowered into the water over the well template or well stub, and oriented on the seabed 14 to the bearing or direction as required. The well template 140 spacing out the conductor pipes 12 at the seabed 14 may be a separate frame structure, as shown in FIG. 11, or may be incorporated as part of the bottom framing of the module 120, as shown in FIG. 12. The template 140 is used to space the wells before the module 120 is set. The conductor guides 40 in the template 140 are located to predetermined spacing so that they match exactly the spacing of the wells at the seabed. A well template 140 is almost always used if more than one well is drilled before the module 120 is set to insure that well spacing will match the spacing of the conductor guides 40. If the module 120 (or the subplatform 20 for that matter) is set after just one well has been drilled, the bottom of the module 120 may incorporate the well guides 40 as shown in FIG. 12, thus a separate template would not be required.

After the bottom box module 120 is positioned on the seabed 14, it is leveled, if necessary, by air or water jetting seabed debris out from under the mudmats 122. This jetting process continues until the lower box module 120 is level within the installation requirements. The second module 110 is then lifted and placed atop the lower box module 120, with the lower extensions 116, best shown in FIG. 9, of the pile sleeves 114 of the module 110 stabbing into the stabbing guides 124 located at the top of the piles sleeves 126 of the lower box module 120. The second box module 110 is lowered in place until it is sitting firmly atop the lower box module 120.

Referring now specifically to FIG. 9, a more detailed view of the stabbing connection between the modules 110 and 120 is shown. The partially broken away view of FIG. 9 depicts one corner of the modules 110 and 120. It is understood that the modules 110 and 120 are connected at each corner in the manner hereinafter described. It is observed that the pile sleeve 114 of the module 110 includes a downwardly depending extension 116 terminating at an open end 117. The extension 116 may be several feet in length and is sized to be received within the pile sleeve 126 of the module 120.

The module 110 is lowered onto the module 120 until the uppermost end of the pile sleeve 126 is engaged by a circumferential flange 128 welded about the outer surface of the pile sleeve 114. The flange 128 is reinforced by stop tabs 130 welded to the backside of the flange 128 and the outer surface of the pile sleeve 114. The stop tabs 130 project outwardly from the flange 128 and are angularly cut for mating engagement with the stabbing guide 132 circumscribing the uppermost open end of the pile sleeve 126. A plurality of support tabs 134 provide structural support for the stabbing guide 132.

Additional box modules may be placed, as necessary, on top of the installed box modules until all box modules 110 are in place and connected to each other. The pyramid module 100 is then lifted and stabbed atop the uppermost box module 110, and connected to the box module 110 in a similar fashion as described above.

During installation of the offshore production platform of the invention, adjustments may be required to properly position the module 100 relative to the waterline 16. Relatively small height adjustments (15 to 20 feet) are accommodated by the present system by installing spacers 140 between the box modules 110 and 120, shown in FIG. 10. The spacer 140 is a pipe section which may be cut to the desired length in the field to provide the overall height required. As best shown in FIG. 10, a spacer 140 may be positioned at each corner between the box modules 110 and 120.

Following placement of the box modules 120 and 110 and the pyramid module 100 on the seabed 14 and connecting to each other in a suitable fashion as specified by the technical specifications and structural drawings, a pile 26 is lifted and inserted through the pile sleeve stabbing guide 136 (FIG. 8) of the pyramid module 100 into the pile sleeve 114. The pile 26 is lowered into the pile sleeve 114 and through the pile sleeve 126 until it makes contact with the seabed 14 and is allowed to penetrate under its own weight some distance into the seabed 14. If the distance to the seabed 14 is too great for a single length of pile, then the pile 26 may be supported at the top of the pile sleeve 114 using centralizing bolts tightened by divers while the next pile section is stabbed into it and fully welded to it. Pile sections may be continually added in this manner until the pile 26 is secured at a stable point below the seabed 14, where the top of the pile 26 is above the water surface. A conventional diesel or steam hammer may then be used to drive pile 26 to the specific penetration depth into the seabed 14 required for a particular installation.

In an alternate embodiment, the piles 26 may be installed by drilling methods. In this instance, a drilling unit is positioned over the top of the pile sleeve 114 and the pile hole is drilled to the specified penetration depth below the seabed 14. The drill bit and drilling pipe are removed from the hole, and the pile is inserted to the bottom of the hole using the section connecting method described above, if necessary. When the pile 26 is resting at the proper penetration it is connected to the pile sleeves 24 by employing an underwater grouting method whereby the grout line is attached to the bottom of the pile sleeve 126, and a pre-specified amount of grout is inserted under pressure into the pile annulus at the bottom of the annulus. This grout is allowed to set up and form a pile plug in the bottom of the annulus. Once the pile plug has set up, then the remainder of the pile annulus is filled with grout and permitted to set up. All skirt piles may be grouted to the pile sleeves simultaneously. However, in the event of a drilled and grouted pile, the pile that is installed into a predrilled hole must be first grouted to the hole through its full annulus and allowed to fully set up before the pile is grouted to the pile sleeve.

The next module to be installed is the boat landing 50. The boat landing 50 is adjustable by virtue of its stabbing guides 53 which are trimmed to correspond to the approximate water depth at the installation site. Once the water depth is determined, and the net positive or negative footage is measured, the stabbing guides 53 on the boat landing modules are trimmed by an appropriate amount. Each boat landing module 50 is then placed onto the king posts 55 that are located on the support columns 22. The top horizontal connection member 57 of each boat landing module 50 is then welded with its doubler plate to the support columns 22. Each boat landing module is installed in this fashion until the boat landing installation is complete.

Next, the spider deck 70 is lifted off of the cargo barge and lowered onto the top of the support columns 22. The spider deck support columns 73 stab into the top of the support columns 22 and are welded to the support columns 22.

The deck 32 is then installed on the spider deck 70. Before lifting deck 32 off the transportation barge, it will be necessary to determine and measure the levelness of the spider deck 70 and perpendicular dimensions. Once the levelness of the spider deck 70 has been determined, the stabbing posts 80 may be trimmed to correspond to the out-of-levelness of the platform, so that when the deck 32 is installed atop the spider deck 70, its levelness will be precise. After the stabbing posts 80 are trimmed properly, the deck 32 is lifted from the cargo barge and installed on top of the spider deck 70. Prior to permanent welding connection, the deck levelness is checked in all directions. The deck 32 is then fully welded out.

Upon welding out of the deck 32, the platform rig deck 35 (if required for the application) is lifted from the cargo barge and installed into its respective deck installation stabbing guide supports. Once the rig legs are in the stabbing guide supports, they are fully welded out. Following this, the helideck is lifted and installed on top of the deck 32.

While the foregoing is directed to the preferred embodiment of the present invention, other and further embodiments of the invention may be devised without departing from the basic scope thereof, and the scope thereof is determined by the claims which follow.

I claim:

1. An offshore production platform for use with at least one well located in a body of water, comprising:

(a) a platform substructure having four comer-located piling sleeves;

(b) a first set of bracing members disposed in horizontal planes between and interconnecting the comer piling sleeves;

(c) a second set of brace members disposed in vertical planes between and interconnecting the comer piling sleeves;

(d) at least four support columns spaced substantially equidistant from each other and connected to said first set of bracing members, wherein the upper ends of said support columns extend above the surface of the body of water and the lower ends thereof are mounted to a center framing structure located interior of said corner piling sleeves, said center framing structure including frame members disposed between and connected to the lower ends of said support columns, said frame members further including guide sleeves extending therethrough for providing a passageway for one or more conductor pipes extending from the seabed to said deck structure;

(e) a set of angular brace members disposed between and interconnecting the support columns and comer piling sleeves; and (f) a deck structure mounted on the upper ends of said support columns.

2. The production platform of claim 1 wherein said platform substructure includes a hollow structural box module, and wherein each face of said box module is defined by said horizontal and vertical bracing members.

3. The production platform of claim 2 including a second platform substructure module for cooperative engagement with and supporting said box module.

4. The production platform of claim 1 wherein said platform substructure includes a pyramidal module formed by said support columns and said angular brace members.

5. The production platform of claim 1 including a modular boat landing mounted on said support columns.

6. The production platform of claim 5 wherein said modular boat landing is mounted on said support columns on a plurality of king posts mounted on said support columns, and wherein said modular boat landing includes adjustable stabbing posts for leveling said boat landing relative to the water surface.

7. The production platform of claim 1 wherein said deck structure comprises a deck supported by diagonal brace members extending from the underside of said deck and connected to said support columns.

8. The production platform of claim 7 wherein said deck includes a stabbing cup at each corner thereof for leveling said deck on said support columns.

9. The production platform of claim 1 comprising at least two modular components.

10. The production platform of claim 1 including first and second platform substructure modules and a pyramidal module.

11. The production platform of claim 10 including spacer means disposed between said first and second substructure modules.

12. A method of installing an offshore production platform on the ocean seabed comprising the steps of:

(a) transporting components of the production platform to an offshore platform site;

(b) positioning a lower box module of the production platform having comer-located piling sleeves over a well template;

(c) securing a pyramidal module of the production platform on top of the box module;

(d) anchoring the box and pyramidal modules to the seabed by driving piles through the module pile sleeves into the seabed;

(e) mounting at least one king post on the pyramidal module at the water surface;

(f) installing a modular boat landing module having adjustable stabbing posts on the at least one king post and securing the boat landing module to the pyramidal module; and (g) installing a deck structure having adjustable stabbing guides on top of the pyramidal module above the water surface.

13. The method of claim 12 including the step of trimming the boat module stabbing posts for leveling the boat module relative to the water surface.

14. The method of claim 12 including the step of trimming the deck structure stabbing guides for leveling the deck structure on the pyramidal module.

15. The method of claim 12 including the step of securing a second box module between the lower box module and the pyramidal module.

16. The method of claim 12 including the step of installing spacers between the box module and the pyramidal module.

17. An offshore production platform for use with at least one well located in a body of water, comprising:

(a) a platform substructure having four corner located piling sleeves;

(b) a first set of bracing members disposed in horizontal planes between and interconnecting the corner piling sleeves;

(c) a second set of brace members disposed in vertical planes between and interconnecting the corner piling sleeves;

(d) a set of support columns connected to said first set of bracing members, wherein the upper ends of said support columns extend above the surface of the body of water;

(e) a set of angular brace members disposed between and interconnecting the support columns and corner piling sleeves;

(f) a modular boat landing supported on said support columns by one or more mounting posts, and wherein said modular boat landing includes adjustable stabbing posts for leveling said boat landing relative to the water surface; and (g) a deck structure mounted on the upper ends of said support columns.

* * * * *